US009984832B2

(12) United States Patent
Takaba et al.

(10) Patent No.: US 9,984,832 B2
(45) Date of Patent: May 29, 2018

(54) TOUCH SENSOR AND METHOD FOR MANUFACTURING THE SAME

(71) Applicant: Hitachi Metals, Ltd., Tokyo (JP)

(72) Inventors: Shinichi Takaba, Hitachi (JP); Kenji Hirose, Hitachi (JP); Koichi Kato, Hitachi (JP); Takashi Fujieda, Hitachi (JP); Keisuke Sugita, Hitachi (JP); Kazuhide Oda, Hitachi (JP); Toshihiro Nakagawa, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 12 days.

(21) Appl. No.: 15/215,450

(22) Filed: Jul. 20, 2016

(65) Prior Publication Data

US 2017/0040126 A1 Feb. 9, 2017

(30) Foreign Application Priority Data

Aug. 3, 2015 (JP) ..... 2015-153364

(51) Int. Cl.

| | |
|---|---|
| ***H01H 9/02*** | (2006.01) |
| ***H01H 3/14*** | (2006.01) |
| ***E05F 15/44*** | (2015.01) |
| *H01H 1/06* | (2006.01) |

(52) U.S. Cl.

CPC ..... *H01H 3/142* (2013.01); *E05F 15/44* (2015.01); *E05Y 2900/531* (2013.01); *H01H 1/06* (2013.01)

(58) Field of Classification Search

CPC ..... H01H 3/142; H01H 1/06; H01H 13/02; H01H 3/16; H01H 35/00; H01H 3/14; H01H 2003/143; E05F 15/44; E05F 15/646; E05Y 2900/531

USPC ..... 200/505, 52 R, 86 R, 61.44

See application file for complete search history.

(56) References Cited

U.S. PATENT DOCUMENTS

| | | | | |
|---|---|---|---|---|
| 5,554,835 A * | 9/1996 | Newham | ..... | G08B 21/22 200/512 |
| 2010/0006407 A1* | 1/2010 | Masuko | ..... | H01H 3/142 200/61.44 |
| 2015/0303008 A1* | 10/2015 | Yujima | ..... | H01H 3/142 200/52 R |

FOREIGN PATENT DOCUMENTS

| | | |
|---|---|---|
| JP | H 10-281906 A | 10/1998 |
| JP | 2000-057879 A | 2/2000 |

* cited by examiner

*Primary Examiner* — Edwin A. Leon

(74) *Attorney, Agent, or Firm* — McGinn IP Law Group, PLLC.

(57) ABSTRACT

A touch sensor includes a hollow tubular member that is elastic and insulative; and a first electrode wire and a second electrode wire held in the tubular member while being separated from each other. The first electrode wire and the second electrode wire contact with each other by elastic deformation when receiving an external pressure to the tubular member. The first electrode wire and the second electrode wire extend parallel to a central axis of the tubular member. A shape of a gap between the first electrode wire and the second electrode wire in a cross section orthogonal to the central axis of the tubular member is non-linear.

14 Claims, 8 Drawing Sheets

TOUCH SENSOR AND METHOD FOR MANUFACTURING THE SAME

The present application is based on Japanese patent application No. 2015-153364 filed on Aug. 3, 2015, the entire contents of which are incorporated herein the reference.

BACKGROUND OF THE INVENTION

1. Field of the Invention

The present invention relates to a touch sensor that is provided with a plurality of electrode wires held inside a hollow tubular member and that provides a switching function by sensing the contact of the electrode wires caused by an external pressure, and a method for manufacturing the touch sensor.

2. Description of the Related Art

A touch sensor that serves to provide a switching function by sensing the contact of the electrode wires caused by an external pressure is used for a slide door etc. of automobiles (see e.g., JP-A-H10-281906 and JP-A-2000-57879).

The touch sensor disclosed in JP-A-H10-281906 is provided with a hollow tubular elastic insulator, and a plurality of the electrodes arranged separately from each other and spirally on an inner peripheral surface of the hollow tubular elastic body. The touch sensor is manufactured by arranging a plurality of the electrode wire along with an outer peripheral surface of the spacer that is formed same shape with the hollow portion, extruding rubber material to the outer periphery surface of the spacer and a plurality of the electrode wires and molding the elastic insulator, then pulling the spacer out.

The touch sensor (i.e., code switch) disclosed in JP-A-2000-57879 is provided with one pair of electrode wires (i.e., elastic conductors) are arranged opposite parallel to each other in an inner peripheral surface of the hollow tubular elastic insulator through the space. A shape of the elastic insulator in a cross section orthogonal to the central axis C of the elastic insulator is track shaped that both ends in width direction is formed arc-shaped. Each opposite surface of the pair of the electrode wires are linear in the central axis of the elastic insulator and inclined flat surface for the flat section of the outer surface of the elastic insulator. This touch sensor is manufactured such that whole shape is approximately elliptic-shaped add a spacer (i.e., solid member) whose shape is in same with the space between the one pair of the electrode wires and the one pair of the electrode wires, its outer peripheral surface is extrusion covered with the elastic insulator, then pulling the spacer out.

SUMMARY OF THE INVENTION

The touch sensor in JP-A-H10-281906 is constructed such that the plurality of the electrode wires are spirally arranged. Thus, the friction resistance between the spacer and the electrode wires become large when the spacer is pulled out, so that it may be a big burden for operator in manufacture thereof.

The touch sensor in JP-A-2000-57879 is constructed such that the pair of the electrode wires are linearly arranged to the tubular elastic insulator. Thus, the friction resistance between the spacer and the electrode wires when the spacer is pulled out is smaller than the touch sensor in JP-A-H10-281906 and the burden decreases. However, if a direction of the external pressure corresponds to the extending direction of the space between the pair of the electrode wires in a cross section orthogonal to the central axis C of the elastic insulator, the electrode wires may not contact with each other if the elastic insulator is not deformed largely. Thus, there is a risk that the sensitivity to the pressure may substantially decrease.

It is an object of the invention to provide a touch sensor that prevents the decrease in the sensitivity to a pressure in a specific direction even when the plurality of electrode wires are arranged parallel to the central axis of the tubular member in the elastic hollow tubular member, as well as the method for manufacturing the touch sensor.

According to an embodiment of the invention, a touch sensor comprises:

a hollow tubular member that is elastic and insulative; and a first electrode wire and a second electrode wire held in the tubular member whole being separated from each other, wherein the first electrode wire and the second electrode wire contact with each other by elastic deformation when receiving an external pressure to the tubular member, wherein the first electrode wire and the second electrode wire extend parallel to a central axis of the tubular member, and wherein a shape of a gap between the first electrode wire and the second electrode wire is non-linear in a cross section orthogonal to the central axis of the tubular member.

According to another embodiment of the invention, a method for manufacturing a touch sensor, wherein the touch sensor comprises a hollow tubular member that is elastic and insulative, and a first electrode wire and a second electrode wire held in the tubular member while being separated from each other, wherein the first electrode wire and the second electrode wire contact with each other by elastic deformation when receiving an external pressure to the tubular member, wherein the first electrode wire and the second electrode wire each comprise a metal line and an insulated elastic body covering the metal line, and extend parallel to a central axis of the tubular member, the method comprising collectively extrusion molding the tubular member, the insulated elastic body of the first electrode wire and second electrode wire such that a shape of a gap between the first electrode wire and the second electrode wire is non-linear in a cross section orthogonal to the central axis of the tubular member.

Effects of the Invention

According to an embodiment of the invention, a touch sensor can be provided that prevents the decrease in the sensitivity to a pressure in a specific direction even when the plurality of electrode wires are arranged parallel to the central axis of the tubular member in the elastic hollow tubular member, as well as the method for manufacturing the touch sensor.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

The First Embodiment

Next, a touch sensor and a method for manufacturing the touch sensor in the first embodiment according to the invention will be described below with the reference to FIGS. 1 to 4. Meanwhile, the embodiments described below are only intended to show preferred examples in enforcing the present invention. Although various technical matters that are technically preferable may be described specifically in some parts of the embodiments, a technical scope of the present invention is not limited by the specific embodiments.

(Configuration of a Touch Sensor)

Figure 1:
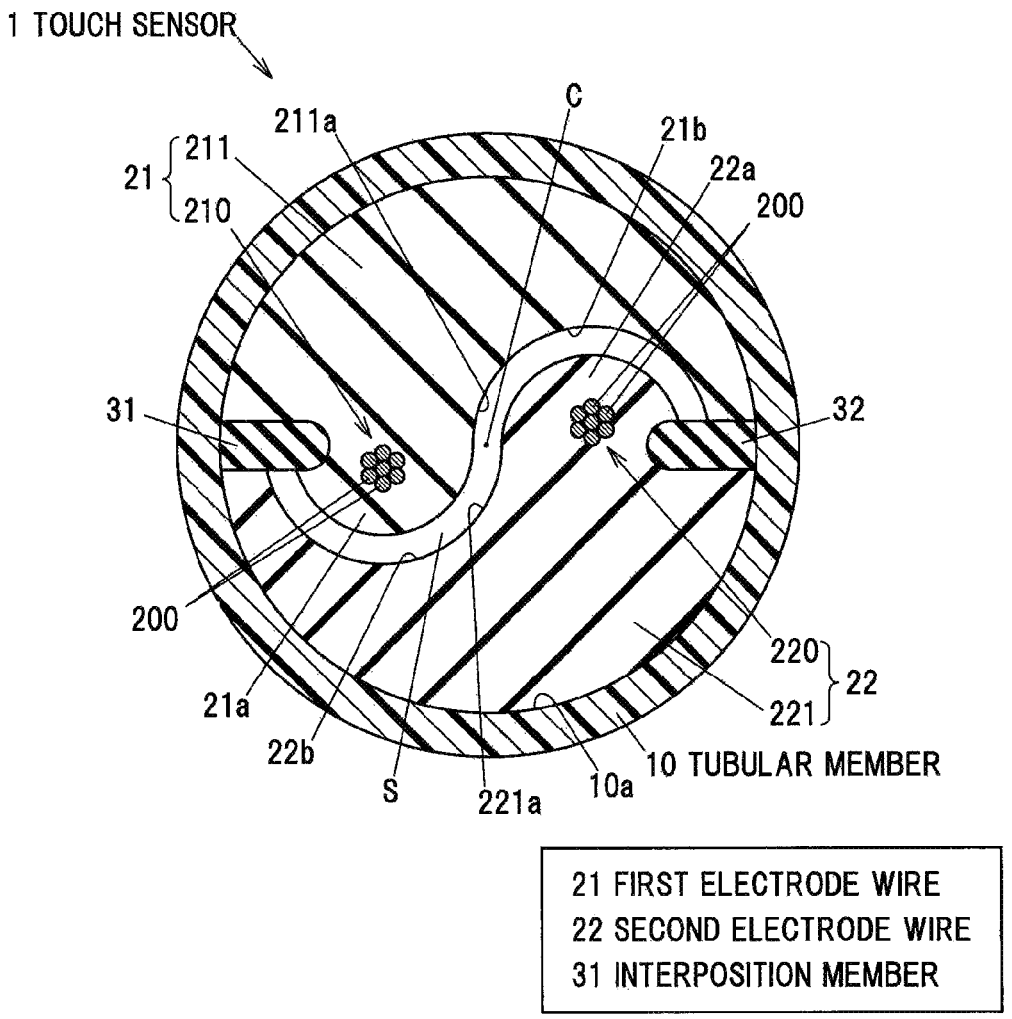
FIG. 1 is a cross sectional view showing a touch sensor in a first embodiment according to the invention.
Figure 2:
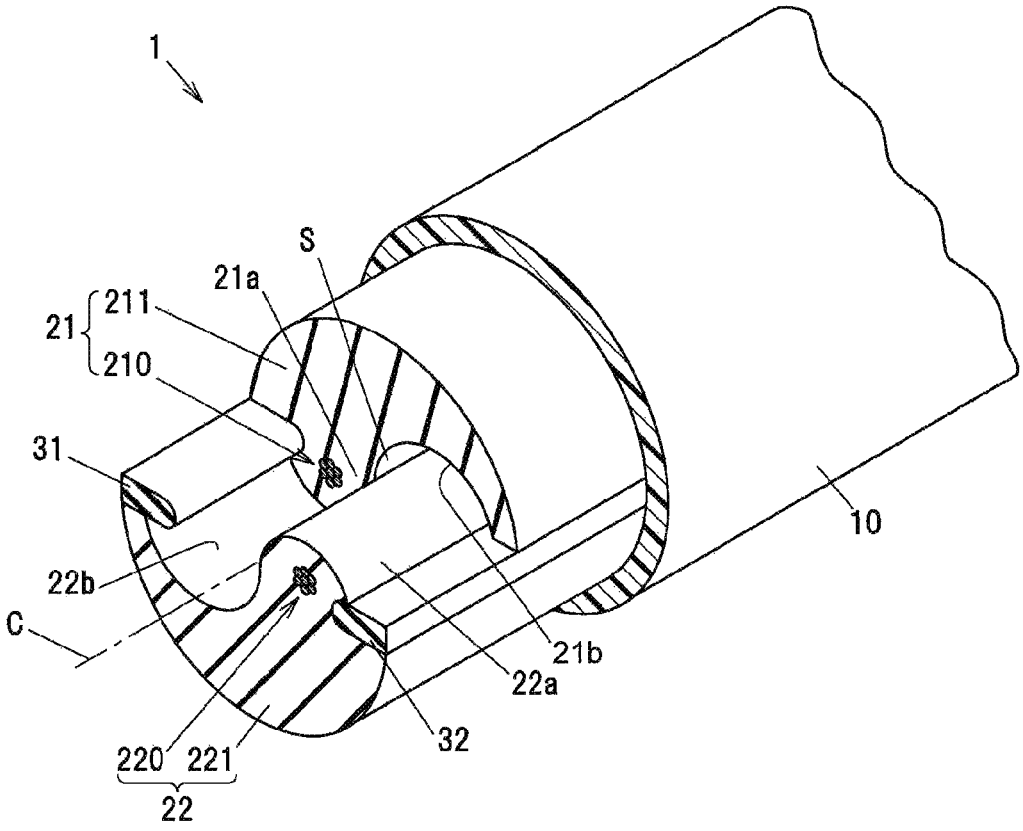
FIG. 2 is a cross perspective view showing components of the touch sensor cut at different positions in an axis direction.

FIG. 1 is a cross sectional view showing a touch sensor in a first embodiment according to the invention. FIG. 2 is a cross perspective view showing components of the touch sensor cut at different positions in the axis direction.

This touch sensor 1 is provided with a hollow tubular member 10 which has elasticity and insulation, a first electrode wire 21 and a second electrode wire 22 which are held inside the tubular member 10 separately, a pair of interposition members 31, 32 interposed between the first electrode wire 21 and the second electrode wire 22. The first electrode wire 21 and the second electrode wire 22 elastically deform and contact (short-circuit) when the tubular member 10 of the touch sensor 1 receives an external pressure. As shown in FIG. 1, the touch sensor is not pressed in a cross section that is orthogonal to central axis C of the tubular member 10.

The tubular member 10 is circular-shaped in cross section orthogonal to the central axis C of the tubular member 10. And the length of the tubular member 10 in longer direction (in parallel to the central axis C) is, for example, 1 to 2 m. Moreover, an outer diameter of the tubular member 10 is, for example, 4 mm. Ethylene propylene rubber having excellent water resistance, chemical resistance, weather resistance and cold resistance is preferable usable as the material of the tubular member 10. The first electrode wire 21 and the second electrode wire 22 are extended parallel to the central axis C of the tubular member 10.

The first electrode wire 21 is provided with a metallic wire 210 and a conductive elastic body 211 that covers the metallic wire 210. Likewise, the second electrode wire 22 is provided with a metallic wire 220 and a conductive elastic body 221 that covers the metallic wire 220.

A plurality of metallic wires 210, 220 are strand wires that strand each of a plurality of (in the present embodiment, seven) wires 200 made of good electrical conductive such as copper. And the conductive elastic body 211, 221 are provided with a conductive elastomer crosslinked rubber combined conductive filler, such as carbon black. The conductive elastic body 211, 221 has elastic to be deformed with the tubular member 10 by receiving the external pressure.

The pair of the interposition members 31, 32 are formed by an insulative elastic body. In the present embodiment, the pair of the interposition members 31, 32 is formed of an insulative elastomer. And the pair of the interposition members 31, 32 is arranged partially contacting an inner surface 10*a* of the tubular member 10.

A gap S is formed between the first electrode wire 21 and the second electrode wire 22. The gap S is a gap between an opposite surface 211*a* to the second electrode wire 22 in the conductive elastic body 211 of the first electrode wire 21 and an opposite surface 221*a* to the first electrode wire 21 in the conductive elastic body 221 of the second electrode wire 22. The shape of the gap S is non-linear (i.e., a term "non-linear" as used herein is meant to exclude a straight-line shape in between both ends in longitudinal direction of the gap) in a cross section that is orthogonal to the central axis C of the tubular member 10. In the present embodiment, the shape of the gap S in the cross section is a curve that is curved S-shaped (i.e., curved in the form of the letter S).

In the cross section shown in FIG. 1, one end of the gap S is ended by the interposition member 31, second end of the gap S is ended by the interposition member 32. The width of the gap S (the distance between the opposite surfaces 211*a* and 221*a* in the conductive elastic bodies 211, 222 of the first electrode wire 21 and the second electrode wire 22) is substantially homogeneous in overall length of the gap S. In the explanation below, for convenience, the first electrode wire 21 side of the gap S calls upper, the second electrode wire 22 side of the gap S calls bottom. Moreover, the interposition member 31 side in the central axis C of the tubular member 10 calls left side, the interposition member 32 side in the central axis C of the tubular member 10 calls right side.

A convex portion 21*a* that is convex downward and a concave portion 21*b* that is concave upward are formed in the first electrode wire 21. Also a convex portion 22*a* that is convex upward and a concave portion 22*h* that is concave upward are formed in the second electrode wire 22. The convex portion 21*a* of the first electrode wire 21 occupies a space defined by the concave portion 22*b* of the second electrode wire 22. Also the convex portion 22*a* of the second electrode wire 22 occupies a space defined by the concave portion 21*b* of the first electrode wire 21. Thereby, the gap S of the touch sensor 1 is curved S-shaped in the cross section orthogonal to the central axis C. The cross section of the first electrode wire 21 and the second electrode wire 22 are formed in point symmetrical shaped in the central axis C.

One end of the interposition member 31 (a central axis C end) penetrates into the convex portion 21*a* of the first electrode wire 21 and one end of the interposition member 32 (a central axis C end) penetrates into the convex portion 22*a* of the second electrode wire 22. Moreover the metallic wire 210 of the first electrode wire 21 is arranged at the central region of the convex portion 21*a* in the first electrode wire 21, and the metallic wire 220 of the second electrode wire 22 is arranged at the central region of the convex portion 22*a* in the second electrode wire 22.

FIGS. 3A to 3D show the deformation states of the touch sensor 1 pressed from an outside of the tubular member 10. In FIGS. 3A to 3D, the direction of the pressure that the touch sensor 1 affects is shown by a pair of arrow heads.

Figure 3A:
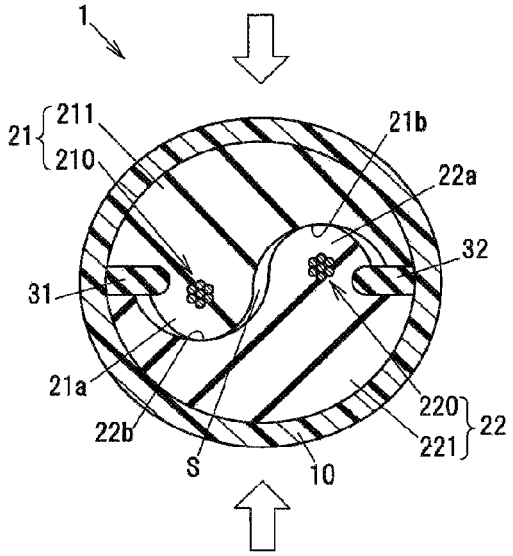
FIGS. 3A to 3D are illustration diagrams showing a deformation state of a touch sensor pressed from an outside of a tubular member in first direction.

FIG. 3A shows a situation that the touch sensor 1 is pressed in a vertical direction. In this situation, an end of the convex portion 21*a* in the first electrode wire 21 contacts a bottom of the concave portion 22*b* in the second electrode wire 22 and an end of the convex portion 22*a* in the second electrode wire 22 contacts a bottom of the concave portion 21*b* in the first electrode wire 21.

Figure 3B:
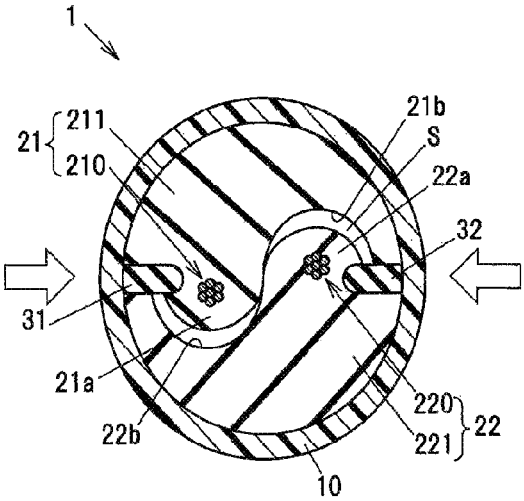

FIG. 3B shows a situation that the touch sensor 1 is pressed in a horizontal direction (orthogonal to the vertical direction). In this situation, a right side surface of the convex portion 21*a* in the first electrode wire 21 contacts a left side surface of the convex portion 22*a* in the second electrode wire 22.

Figure 3C:
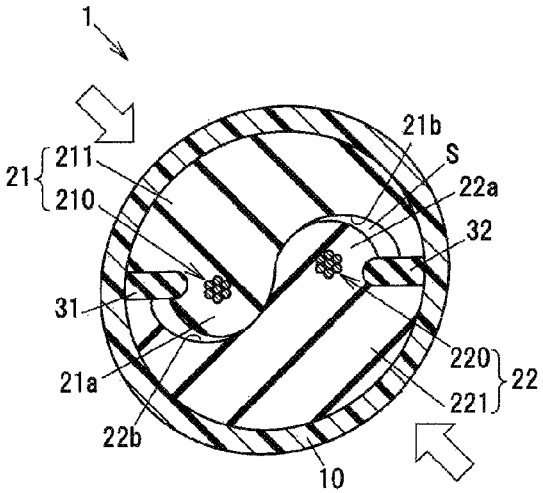

FIG. 3C shows a situation that the touch sensor 1 is pressed in a diagonally upper left direction and a diagonally downward right direction. In this situation, comparing with the situation shown in FIG. 3B, the convex portion 21*a* in the first electrode wire 21 occupies more deeply a space defined at the bottom side of the concave portion 22*b* in the second direction wire 22 and the convex portion 22*a* in the second electrode wire 22 occupies more deeply a space defined at the bottom side of the concave portion 21*b* in the first direction wire 21. Accordingly, as compared with the situation in FIG. 3B, the first electrode wire 21 and the second electrode wire 22 contact with each other on a larger area.

Figure 3D:
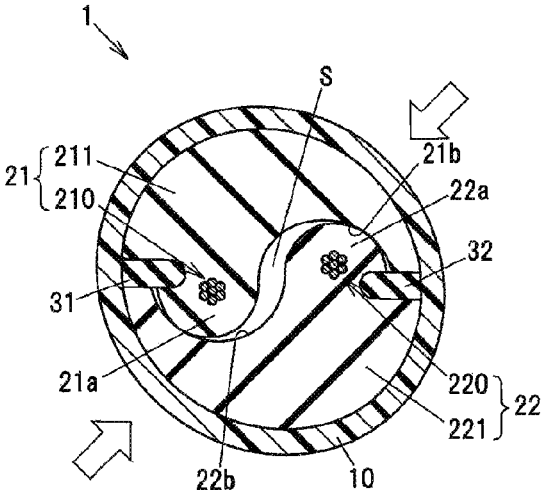

FIG. 3D shows a situation that the touch sensor 1 is pressed in a diagonally upper right direction and a diagonally lower left direction. In this situation, part of a left side from the end of the convex portion 21*a* in the first electrode wire 21 contacts an inner surface of the concave portion 22*b* in the second electrode wire 22 and part of a right side from the end of the convex portion 22*a* in the second electrode wire 22 contacts an inner surface of the concave portion 21*b* in the first electrode wire 21.

Accordingly, the first electrode wire 21 and the second electrode wire 22 contacts at least one region even if the touch sensor 1 is pressed from any directions. Also, the touch sensor 1 can be suppressed decreasing substantially sensitivity by a pressure in a specific direction, comparing with the situation that if the shape of the gap S in the cross section orthogonal to the central axis C is linear. Herein the sensitivity can be defined as the inverse number of the amount of the minimum pressure to contact the first electrode wire 21 and the second electrode wire 22. That is, the higher sensitivity, the first electrode wire 21 contacts the second electrode wire 22 by the smaller pressure.

(Electrical Circuit Including a Touch Sensor)

Figure 4:
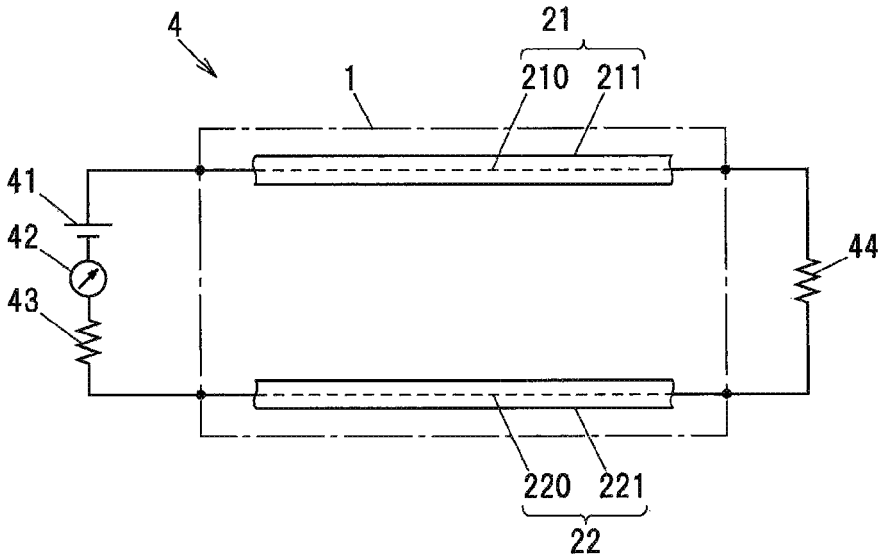
FIG. 4 is a circuit diagram showing an electrical circuit that detects an external pressure to a touch sensor.

FIG. 4 is a circuit diagram showing an electrical circuit 4 that detects an external pressure to the touch sensor 1. The electrical circuit 4 is provided with the touch sensor 1, a DC (direct current) source 41, an ampere meter 42, a first resistance 43 and the second resistance 44.

The DC source 41, the ampere meter 42, and the first resistance 43 are connected in series between the metallic wire 210 in the first electrode wire 21 and the metallic wire 220 in the second electrode wire 22 at one end of the touch sensor 1. The second resistance 44 is connected between the metallic wire 210 in the first electrode wire 21 and the metallic wire 220 in the second electrode wire 22 at the other end of the touch sensor 1.

When the touch sensor 1 does not receive the external pressure, the first electrode wire 21 and the second electrode wire 22 does not contact and the ampere meter 42 measure an electrical current value that source voltage of the DC source 41 divides a resistance value of a combined resistance of the first resistance 43 and the second resistance 44. Otherwise, when the touch sensor 1 receives the external pressure and the first electrode wire 21 and the second electrode wire 22 contact at least one region, the ampere meter 42 measure the electrical current value that source voltage of the DC source 41 divides a resistance value of the first resistance 43. That is to say, if the value of the first resistance 43 is equal to the value of the second resistance 44, the ampere meter 42 measures about a current value twice as the touch sensor 1 does not receives the external pressure, when the touch sensor 1 receive the external pressure. Therefore, the existence of the contact between the first electrode wire 21 and the second electrode wire 22 can be detected based on the measure value of the ampere meter 42.

Further, it is enough to detect whether or not the electrical current flowing through the electrical circuit 4 is more than predetermined threshold, for example, a simple configuration of the electrical circuit 4 is possible to use to only detect whether or not the potential difference between both ends of a shunt resistance is more than predetermined value.

(Method for Manufacturing Touch Sensor)

The touch sensor 1 is manufactured by using extrusion molding that collectively extrudes the tubular member 10, the conductive elastic bodies 211, 221 of the first electrode wire 21 and the second electrode wire 22, and the pair of interposition members 31, 32 such that the shape of the gap S between the first electrode wire 21 and the second electrode wire 22 in the cross section orthogonal to the central axis C in the tubular member 10 become non-linear shaped. In particular, the touch sensor 1 is manufactured by using multicolor extrude method that use die that have openings whose shapes are corresponding to the tubular member 10, the conductive elastic bodies 211, 221 of the first electrode wire 21 and the second electrode wire 22, and the pair of interposition members 31, 32 respectively.

The conductive elastic body 211, 221 of the first electrode wire 21 and the second electrode wire 22 and the pair of interposition members 31, 32 are integrated with contacting the inner surface 10*a* of the tubular member 10 by extruding with the tubular member 10. That is to say, the conductive elastic bodies 211, 221 of the first electrode wire 21 and the second electrode wire 22, and the pair of interposition members 31, 32 are extrusion molded so as to contact the inner surface 10*a* in the tubular member 10.

Also, this extrusion molding molds the conductive elastic bodies 211, 221 of the first electrode wire 21 and the second electrode wire 22 such that the convex portion 21*a* in the first electrode wire 21 occupies a space defined by the concave portion 22*b* in the second electrode wire 22 and the convex portion 22*a* in the second electrode wire 22 occupies a space defined by the concave portion 21*b* in the first electrode wire 21. That is to say, the conductive elastic bodies 211, 221 of the first electrode wire 21 and the second electrode wire 22 are extrusion molded such that the gap S in the cross section orthogonal to the central axis C becomes S-shaped. Thereby, the gap S between the first electrode wire 21 and the second electrode wire 22 can be formed without using a spacer that is used in manufacturing, for example, a usual touch sensor.

As the pair of the interposition members 31, 32 are arranged at positions corresponding to both ends of the gap S, the first electrode wire 21 and the second electrode wire 22 can be certainly separated when the touch sensor does not receive the external pressure.

(Effect of the First Embodiment)

The first embodiment as explained above has the following advantageous effects.

(1) As the shape of the gap S in the cross section orthogonal to the central axis C is non-linear, the touch sensor can avoid significantly decreasing sensitivity by the pressure from a specific direction, while the first electrode wire 21 and the second electrode wire 22 are arranged parallel to the central axis C inside the tubular member 10.

(2) As the gap S in the cross section orthogonal to the central axis C is S-shaped, sensitivity dispersion caused by the direction acting pressure can be suppressed sufficiently.

(3) As the pair of interposition members 31, 32 are sandwiched between the first electrode wire 21 and the second electrode wire 22, the touch sensor 1 can prevent contacting the conductive elastic bodies 211, 221 of the first electrode wire 21 and the second electrode wire 22 in extrusion molding. Also too high sensitivity in the vertical direction caused by easily contacting the first electrode wire 21 and the second electrode wire 22 when the touch sensor 1 is pressed in vertical direction sandwiching the gap can be suppressed.

(4) As one pair of the interposition members 31, 32 are arranged at both ends of an extended direction of the gap S in the cross section orthogonal to the central axis C and arranged so as to contact the inner surface 10*a* of the tubular member 10, a sensitivity for the pressure is suitably adjusted without excessively suppressing contacting between the first electrode wire 21 and the second electrode wire 22.

(5) As the touch sensor 1 is manufactured by using extrusion molding that extrudes the tubular member 10, the conductive elastic bodies 211, 221 of the first electrode wire 21 and the second electrode wire 22, and the pair of interposition members 31, 32 collectively, manufacturing the touch sensor 1 is not needed to use the spacer that is used in manufacturing the usual touch sensor. Thus the process to pull out the spacer can omit. The manufacturing cost can be decreased.

Further, in the present embodiment, the manufacturing method for the touch sensor 1 without using the spacer to form the gap S by using extrusion molding that extrudes the tubular member 10, the conductive elastic bodies 211, 221 of the first electrode wire 21 and the second electrode wire 22 collectively is explained, it is not limited thereof, the touch sensor 1 can be manufactured by using the spacer to form the gap S whose cross section is S-shaped. Also in this case, as the first electrode wire 21 and the second electrode wire 22 are extended in linear to the central axis C of the tubular member 10, the spacer can be pulled out easily.

Figure 5:
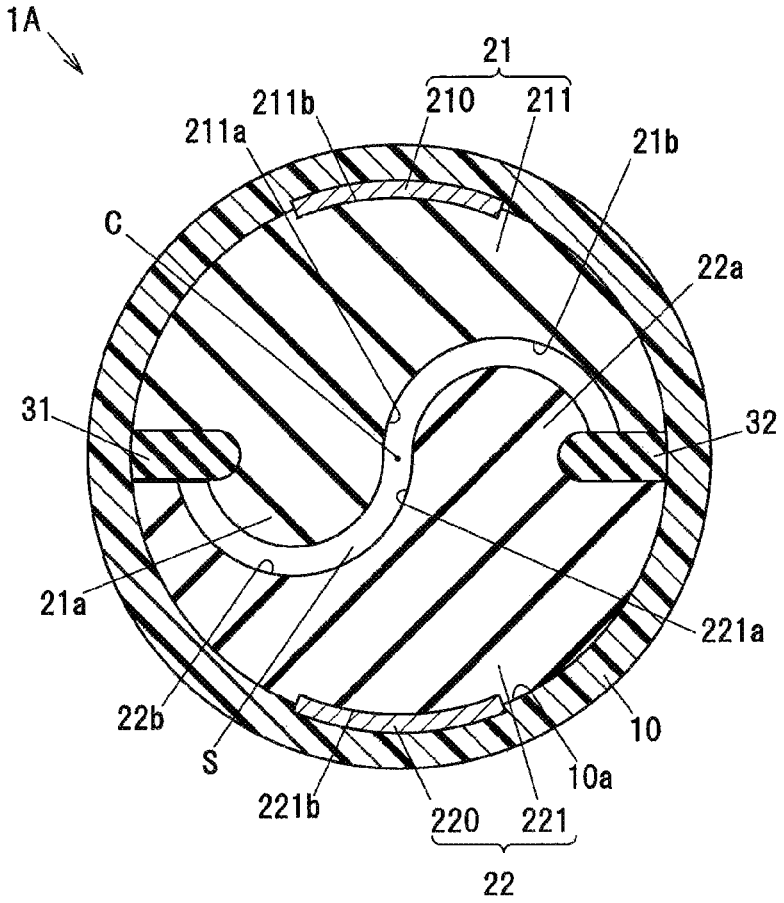
FIG. 5 is a cross sectional view showing a touch sensor a metallic wire formed of a copper foil in a modification of the embodiment.

Further, in the present embodiment, the embodiment that the metallic wire 210 in the first electrode wire 21 and the metallic wire 220 in the second electrode wire 22 are strand wires that strand each of a plurality of wires 200 is explained, it is not limited thereof, the metallic wires 210, 220 can be, for example, foil shaped. FIG. 5 shows a touch sensor 1A made the metallic wires 210, 220 of copper foil in alternative example. In the touch sensor 1A, the metallic wire 210 in the first electrode wire 21 is arranged at between the inner surface 10*a* of the tubular member 10 and the outer peripheral surface 211*b* of the conductive elastic body 211, and the metallic wire 220 in the second electrode wire 22 is arranged at between the inner surface 10*a* of the tubular member 10 and the outer peripheral surface 221*b* of the conductive elastic body 221. Other configuration is as well as the touch sensor 1 in the first embodiment. Therefore, the same reference numerals are assigned to the elements having substantially the same functions as the elements in the first embodiment and the redundant description thereof is omitted. Even this alternative example can obtain the advantageous in (1) to (5) described above.

Other Embodiments

Next, other embodiments according to the present invention will be described below with reference to FIGS. 6 to 8.

Figure 6:
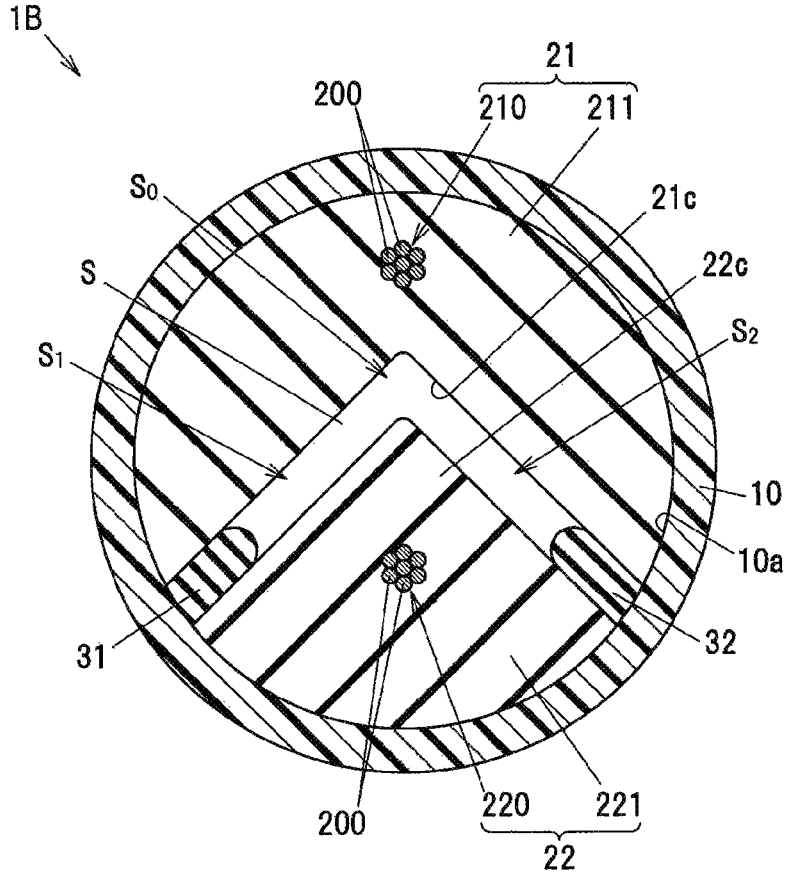
FIG. 6 is a cross sectional view showing a touch sensor in a second embodiment according to the invention.

FIG. 6 is a cross sectional view showing a touch sensor 1B in a second embodiment according to the invention. FIG. 7 is a cross sectional view showing a touch sensor 1C in a third embodiment according to the invention. FIG. 8 is a cross sectional view showing a touch sensor 1D in a fourth embodiment according to the invention.

The touch sensors 1B to 1D in the second to fourth embodiments are provided with, as with the touch sensor 1 in the first embodiment, the hollow tubular member 10 which has elasticity and insulation, the first electrode wire 21 and the second electrode wire 22 which extends parallel to the central axis C inside the tubular member 10, the pair of interposition members 31, 32 interposed between the first electrode wire 21 and the second electrode wire 22 and a plurality of the metallic wires 210, 220 are covered with the conductive elastic bodies 211, 221 in the first electrode wire 21 and the second electrode wire 22. However, shapes of the first electrode wire 21 and the second electrode wire 22 and position of the one pair of the interposition member 31, 32 are different from the touch sensor 1 in the first embodiment. In FIGS. 6 to 8 show the touch sensors 1B to 1D in a cross section orthogonal to the central axis C of the tubular members 10. All of the gaps S between the first electrode wire 21 and the second electrode wire 22 are non-linear.

Also, the touch sensors 1B to 1D are, as with the touch sensor 1 in the first embodiment, manufactured by using extrusion molding that extrudes the tubular member 10, the conductive elastic bodies 211, 221 of the first electrode wire 21 and the second electrode wire 22, and the pair of interposition members 31, 32 collectively. Below, the configurations of each of the touch sensors 1B, 1C, 1D will be explained in detail.

Second Embodiment

As shown in FIG. 6, the touch sensor 1B of the second embodiment is constructed such that a concave portion 21*c* formed triangular in cross section is formed in the first electrode wire 21 and a convex portion 22*c* that is formed in the second electrode wire 22 occupies a space defined by the triangular concave portion 21*c*. Accordingly, a gap S between the first electrode wire 21 and the second electrode wire 22 includes a first straight portion $S_1$ and a second straight portion $S_2$ that are extended from one curve portion $S_0$ for different directions mutually. In the present embodiment, although the angle between the first straight portion $S_1$ and the second straight portion $S_2$ is a right-angle, it is not limited to thereof, the angle between the first straight portion $S_1$ and the second straight portion $S_2$ may be an acute-angle or an obtuse-angle that is between 60 to 120 degrees.

Then, in the touch sensor 1B, one of the interposition members 31 is arranged at the end of the first straight portion $S_1$ that is opposite to the curve portion $S_0$, the other interposition member 32 is arranged at the end of the second straight portion $S_2$ that is opposite to the curve portion $S_0$.

When the touch sensor is pressed in vertical direction (alignment direction of the first electrode wire 21 and the second electrode wire 22, which are intervening the gap S), the gap S is shrunk and an edge of the convex portion 22*c* formed in the second electrode wire 22 contacts the bottom of the concave portion 21*c* in the first electrode wire 22. And when the touch sensor 1B is pressed in the direction inclined or orthogonal to the vertical direction, the gap S in which is arranged at least any one of the first straight portion $S_1$ or the second straight portion $S_2$ is shrunk and the first electrode wire 21 contacts the second electrode wire 22. Thereby, the touch sensor can avoid significantly decreasing sensitivity for the pressure from a specific direction.

Third Embodiment

Figure 7:
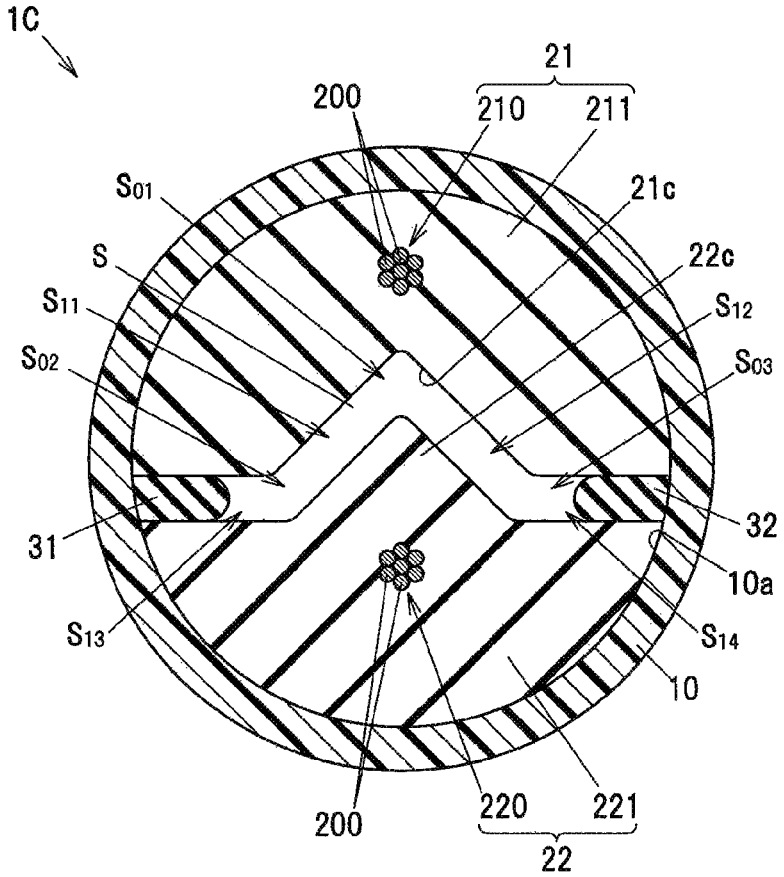
FIG. 7 is a cross sectional view showing a touch sensor in a third embodiment according to the invention.

As shown in FIG. 7, the touch sensor 1C of the third embodiment is constructed such that, as with the touch sensor 1B in the second embodiment, the concave portion 21*c* formed triangular in cross section is formed in the first electrode wire 21, and the convex portion 22*c* that occupies a space defined by the triangular concave portion 21*c* of the first electrode wire 21. The size of the concave portion 21*c* and the convex portion 22*c* is formed smaller than that in the touch sensor 1B. Accordingly, the gap S between the first electrode wire 21 and the second electrode wire 22 in the touch sensor 1C includes three curve portions (a first curve portion $S_{01}$, a second curve portion $S_{02}$ and a third curve portion $S_{03}$) and four straight portions (a first straight portion $S_{11}$, a second straight portion $S_{12}$, a third straight portion $S_{13}$ and a fourth straight portion $S_{14}$).

The first curve portion $S_{01}$ is located at between the edge of the concave portion 21*c* in the first electrode wire 21 and the bottom of the convex portion 22*c* in the second electrode wire 22. The second curve portion $S_{02}$ is located at between the first curve portion $S_{02}$ and the interposition member 31, and the third curve portion $S_{03}$ is located at between the first curve portion $S_{01}$ and the interposition member 32. The first straight portion $S_{11}$ and the second straight portion $S_{12}$ are extended from the first curve portion $S_{01}$ for the different directions each other, the first straight portion $S_{11}$ is located at between the first curve portion $S_{01}$ and the second curve portion $S_{02}$, and the second straight portion $S_{12}$ is located at between the first curve portion $S_{01}$ and the third curve portion $S_{03}$. Also the third straight portion $S_{13}$ is located at between the second curve portion $S_{02}$ and the interposition member 31, the fourth straight portion $S_{14}$ is located at between the third curve portion $S_{03}$ and the interposition member 32.

In the present embodiment, the angle between the first straight portion $S_{u}$ and the second straight portion $S_{12}$ is the right-angle. The angle between the first straight portion $S_{11}$ and the third straight portion $S_{13}$ and the second straight portion $S_{12}$ and the fourth straight portion $S_{14}$ are the obtuse-angle respectively. However, the angle between each of the straight portions are not limited to thereof.

Also, in the touch sensor 1C, as with the touch sensor 1B in the second embodiment, the touch sensor can avoid significantly decreasing sensitivity for the pressure from a specific direction.

Fourth Embodiment

Figure 8:
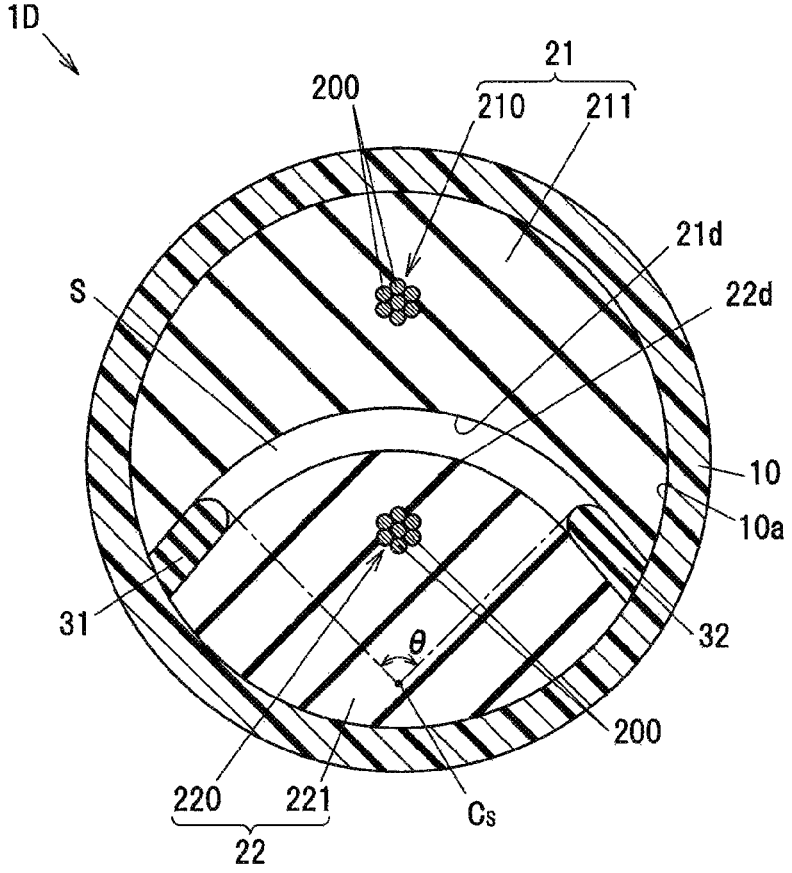
FIG. 8 is a cross sectional view showing a touch sensor in a fourth embodiment according to the invention.

As shown in FIG. 8, the touch sensor 1D of the fourth embodiment is constructed such that the gap S between the first electrode wire 21 and the second electrode wire 22 is arc-shaped, and a space defined by the concave portion 21*d* formed in the first embodiment wire 21 is occupied by the convex portion 22*d* formed in the second embodiment wire 22. A circular arc angles θ of the gap S that is centered at a circular arc center point is more than 90°.

Also, in the touch sensor 1D, as with the touch sensor 1B of the second embodiment and the touch sensor 1C of the third embodiment, the touch sensor can avoid significantly decreasing sensitivity for the pressure from a specific direction.

SUMMARY OF THE EMBODIMENTS

Next, technical ideas understood from the embodiments as described above will be described below with using the reference numerals, etc., used in the description of the embodiments. However each reference numeral, etc., described below is not intended to limit the constituent elements in the claims to the members, etc., specifically described in the embodiments.

[1] A touch sensor (1, 1A, 1B, 1C, 1D), comprising:

a hollow tubular member (10) that is elastic and insulative; and a first electrode wire (21) and a second electrode wire (22) held in the tubular member (10) while being separated from each other, wherein the first electrode wire (21) and the second electrode wire (22) contact with each other by elastic deformation when receiving an external pressure to the tubular member (10), wherein the first electrode wire (21) and the second electrode wire (22) extend parallel to a central axis (C) of the tubular member (10), and wherein a shape of a gap (S) between the first electrode wire (21) and the second electrode wire (22) in a cross section orthogonal to the central axis (C) of the tubular member (10) is non-linear.

[2] The touch sensor (1, 1A, 1B, 1C, 1D) according to [1], further comprising an interposition member (31, 32) that is insulative and lies between the first electrode wire (21) and the second electrode wire (22).

[3] The touch sensor (1, 1A, 1B, 1C, 1D) according to [2], wherein the interposition member (31, 32) is arranged in contact with an inner surface (10*a*) of the tubular member (10).

[4] The touch sensor (1, 1A, 1B, 1C, 1D) according to [1], wherein a concave portion (21*b*, 21*c*, 21*d*, 22*b*) formed in one of the first electrode wire (21) and the second electrode wire (22) is occupied by a convex portion (21*a*, 22*a*, 22*c*, 22*d*) formed in an other of the first electrode wire (21) and the second electrode wire (22).

[5] The touch sensor (1, 1A) according to [4], wherein the gap (S) is curved in form of a S-shape in the cross section.

[6] The touch sensor (1B, 1C, 1D) according to [4], wherein the gap (S) comprises one pair of straight portions ($S_1$, $S_2$, $S_{11}$, $S_{12}$, $S_{13}$, $S_{14}$) that extend in different directions from each other from at least one curve portion ($S_{01}$, $S_{02}$, $S_{03}$, $S_{04}$).

[7] A method for manufacturing a touch sensor (1, 1A, 1B, 1C, 1D), wherein the touch sensor comprises a hollow tubular member (10) that is elastic and insulative, and a first electrode wire (21) and a second electrode wire (22) held in the tubular member (10) while being separated from each other, wherein the first electrode wire (21) and the second electrode wire (22) contact with each other by elastic deformation when receiving an external pressure to the tubular member (10), wherein the first electrode wire (21) and the second electrode wire (22) each comprise a metal line (210, 220) an insulated elastic body (211, 221) covering the metal line (210, 220), and extend parallel to a central axis (C) of the tubular member (10), and the method comprising collectively extrusion molding the tubular member (10), the insulated elastic body (211, 221) of the first electrode wire (21) and second electrode wire (22) such that a shape of a gap (S) between the first electrode wire (21) and the second electrode wire (22) is non-linear in a cross section orthogonal to the central axis (C) of the tubular member (10).

[8] The method according to [7], wherein the touch sensor further comprises an interposition member (31, 32) that is insulative and lies between the first electrode wire (21) and the second electrode wire (22), wherein the interposition member (31, 32) is collectively extrusion molded with the tubular member (10) and the insulated elastic body (211, 221) of the first electrode wire (21) and second electrode wire (22).

[9] The method according to [8], wherein the interposition member (31, 32) is extrusion molded so as to contact with an inner surface (10*a*) of the tubular member (10).

[10] The method according to [7], wherein in the cross section, the insulated elastic body (211, 221) of the first electrode wire (21) and second electrode wire (22) is extrusion molded such that a concave portion (21*b*, 21*c*, 21*d*, 22*b*) formed in one of the first electrode wire (21) and the second electrode wire (22) is occupied by a convex portion (21*a*, 22*a*, 22*c*, 22*d*) formed in an other of the first electrode wire (21) and the second electrode wire (22).

[11] The method according to [10], wherein the gap (S) is curved S-shaped in the cross section by the extrusion molding.

[12] The method according to [10], wherein the extrusion molding is conducted such that the shape of the gap (S) comprises one pair of straight portions ($S_1$, $S_2$, $S_{11}$, $S_{12}$, $S_{13}$, $S_{14}$) that extend in different directions from each other from at least one curve portion ($S_0$, $S_{01}$, $S_{02}$, $S_{03}$).

Although the embodiments of the invention have been described, the invention is not to be limited to the embodiments. Further, it should be noted that all combinations of the features described in the embodiments are not necessary to solve the problem of the invention.

Also, the various kinds of modifications can be implemented without departing from the gist of the invention. For example, the metallic wires 210, 220 of the touch sensors 1B to 1D in the second to fourth embodiments are formed by the copper foil as well the touch sensor 1A in the alternative example of the first embodiment. Also a number of the metallic wires arranged inside the tubular member 120 is not limited to two, may be more than three.

What is claimed is:

1. A touch sensor, comprising:

a hollow tubular member that is elastic and insulative; and a first electrode wire and a second electrode wire held in the tubular member while being separated from each other, wherein the first electrode wire and the second electrode wire contact with an inner wall of the tubular member, and contact with each other by elastic deformation when receiving an external pressure to the tubular member, wherein the first electrode wire and the second electrode wire extend straightly along and in parallel to a central axis of the tubular member, and wherein a shape of a gap between the first electrode wire and the second electrode wire in a cross section orthogonal to the central axis of the tubular member is non-linear.

2. The touch sensor according to claim 1, further comprising an interposition member that is insulative and lies between the first electrode wire and the second electrode wire.

3. The touch sensor according to claim 2, wherein the interposition member is arranged in contact with an inner surface of the tubular member.

4. The touch sensor according to claim 1, wherein in the cross section, a concave portion formed in one of the first and second electrode wires is occupied by a convex portion formed in an other of the first and second electrode wires.

5. The touch sensor according to claim 4, wherein the gap is curved in a form of an S-shape in the cross section.

6. The touch sensor according to claim 4, wherein the shape of the gap comprises one pair of straight portions that extend in different directions from each other from at least one curve portion.

7. The touch sensor according to claim 1, wherein an entirety of the first electrode wire extends straightly along and in parallel to the central axis of the tubular member.

8. The touch sensor according to claim 7, wherein an entirety of the second electrode wire extends straightly along and in parallel to the central axis of the tubular member.

9. The touch sensor according to claim 1, wherein an entirety of an outer circumference surface of the first electrode wire is parallel to and contacts with the inner wall of the tubular member.

10. The touch sensor according to claim 9, wherein an entirety of an outer circumference surface of the second electrode wire is parallel to and contacts with the inner wall of the tubular member.

11. The touch sensor according to claim 1, wherein, around the gap between the first electrode wire and the second electrode wire, an inner circumference surface of the first electrode wire contacts an inner circumference surface of the second electrode wire.

12. The touch sensor according to claim 1, wherein, in a longitudinal direction of an extension of the touch sensor along the central axis of the tubular member, an inner circumference surface of the first electrode wire abuts an inner circumference surface of the second electrode wire.

13. The touch sensor according to claim 1, further comprising an interposition member disposed, between the first electrode wire and the second electrode wire, parallel to the central axis of the tubular member.

14. The touch sensor according to claim 13, wherein the gap extends from the interposition member such that inner circumference surfaces of the first electrode wire and the second electrode wire abut opposing surfaces of the interposition member.

* * * * *